US006119593A

United States Patent [19]

Pollock

[11] Patent Number: 6,119,593

[45] **Date of Patent: *Sep. 19, 2000**

[54] APPARATUS AND METHOD FOR CHANGING IMAGES DURING OPERATION OF A PRINTING PRESS

[75] Inventor: David Clarke Pollock, Somersworth, N.H.

[73] Assignee: Heidelberger Druckmaschinen AG, Heidelberg, Germany

[ * ] Notice: This patent is subject to a terminal disclaimer.

[21] Appl. No.: 09/264,073

[22] Filed: Mar. 8, 1999

Related U.S. Application Data

[63] Continuation-in-part of application No. 08/908,736, Aug. 7, 1997, Pat. No. 5,904,093.

[51] Int. Cl.[7] ..... B41F 31/00

[52] U.S. Cl. ..... 101/349.1; 101/177; 101/217

[58] Field of Search ..... 101/143, 177, 101/217–219, 178–185, 221, 225, 247, 140–145, 139, 483–486, 492, 349.1

[56] References Cited

U.S. PATENT DOCUMENTS

| | | | |
|---|---|---|---|
| 2,384,843 | 9/1945 | Lowe | 101/135 |
| 2,425,167 | 8/1947 | Whitehead | 101/221 |
| 4,346,656 | 8/1982 | Schwaab et al. . | |
| 4,919,046 | 4/1990 | Kakko-Chilof . | |
| 5,063,844 | 11/1991 | Fausel | 101/247 |
| 5,904,093 | 5/1999 | Pollock | 101/177 |

FOREIGN PATENT DOCUMENTS

| | | |
|---|---|---|
| 0 465 789 | 1/1992 | European Pat. Off. . |
| 0 509 414 | 10/1992 | European Pat. Off. . |
| 33 13 219 | 10/1984 | Germany . |
| 84 10 619 | 3/1985 | Germany . |
| 39 17 340 | 11/1990 | Germany . |

*Primary Examiner*—Kimberly Asher
*Attorney, Agent, or Firm*—Kenyon & Kenyon

[57] ABSTRACT

An apparatus and method allowing the changing of image plates or cassettes in an offset printing apparatus without the need to stop the press. Each blanket cylinder is associated with two image cylinders, where each image cylinder carries an associated image plate or cassette. When one of the image cylinders is engaged with the blanket cylinder, thereby transferring an image for printing on the web, the other image cylinder is disengaged from the blanket cylinder. As a result, the other image cylinder is stopped, allowing the image plate or cassette to be changed without the need to stop the entire press operation. After the image plate or cassette is changed on the stopped image cylinder, that image cylinder may be subsequently engaged with the blanket cylinder, while the other image cylinder is disengaged, thereafter allowing that image cylinder to have its image plate or cassette changed. The present invention can include a driving and clutching arrangement which allows an image cylinder which has been stopped for image plate or cassette exchange to be restarted and engaged with the blanket cylinder, while the other image cylinder which was engaged with the blanket cylinder and printing on the web is stopped. In an alternative embodiment of the present invention, two image cylinders and inking units are mounted together on a frame for lateral movement relative to the blanket cylinder, such that lateral movement of one image cylinder and inking unit away from and out of engagement with the blanket cylinder results in lateral movement of the other image cylinder and inking unit toward and into engagement with the blanket cylinder. In an alternative embodiment, each of the plate cylinders has an auxiliary motor. Each auxiliary motor accelerates and decelerates one of the plate cylinders individually.

10 Claims, 8 Drawing Sheets

8
6
7
3
10
11
4
5
12
P1
BLNKT
9
14
13
1
2
17
31
17
16
15

8
7
6
3
11
4
5
12
P1
BLNKT
14
9
13
1
2
17
31
17
16
15

APPARATUS AND METHOD FOR CHANGING IMAGES DURING OPERATION OF A PRINTING PRESS

This application is a continuation-in-part of U.S. patent application Ser. No. 08/908,736, filed Aug. 7, 1997, now U.S. Pat. No. 5,904,093.

BACKGROUND OF THE INVENTION

1. Field of the Invention

The present invention relates to the field of offset printing. In particular, the present invention relates to a device for changing image plates in an offset printing press while the press is running.

2. Description of the Prior Art

Offset printing presses are well known in the prior art. In such devices, a blanket cylinder and an image or plate cylinder are used to print on one side of a web of material (e.g., paper) in contact with the blanket cylinder. The blanket cylinder receives an ink image from the image cylinder, and transfers that image to the web of material. The image cylinder usually contains an image plate, upon which is the image to be printed. The image cylinder alternatively can include a cassette of imageable material, which material is pre-imaged or imaged by an imager on the press. Various ink fountains and inker rolls, as well as dampeners, are used to transfer ink to the image plate or imageable material on the image cylinder, to thereby provide ink to the image cylinder for later transfer of the inked image to the blanket cylinder.

In offset printing presses of the prior art, each blanket cylinder is usually associated with a single image cylinder. In such printing presses, when it is time to change the image plate or cassette, either because of maintenance requirements or because of the need to print a new image, it is necessary to stop the press. Because a single image cylinder is used to transfer an image to the blanket cylinder, it is not possible to run the press while the image plate on, or cassette in, the image cylinder is being removed and replaced.

Stopping the press to change an image plate or cassette acts as an interruption to the printing process, slowing down the overall printing process. In addition to the delays caused by changing the image plate or cassette, there are also additional potential delays associated with restarting the press. These delays are the result of the dangers of breaking the web as the printing process is restarted and the press runs up to full speed. Starting and stopping of the press for image plate or cassette changes increases the risks of web breakage, which breakage can introduce additional delays by requiring the web to be re-threaded through the press and for any web scraps to be removed from the press.

SUMMARY OF THE INVENTION

The present invention relates to an apparatus and method allowing the changing of image plates or cassettes in an offset printing apparatus without the need to stop the press. The present invention therefore eliminates the problems of the prior art which caused potential delays in the printing process as the result of the need to stop the press for image plate or cassette removal and replacement.

In the present invention, each blanket cylinder is associated with at least two image cylinders, where each image cylinder carries an image plate or cassette. When one of the image cylinders is engaged with ("on impression") the blanket cylinder, thereby transferring an image for printing on the web, the other image cylinder is disengaged from ("off impression") the blanket cylinder. As a result, the other image cylinder may be stopped, allowing the image plate or cassette to be changed without the need to stop the entire press operation. After the image plate or cassette is changed on the stopped image cylinder, that image cylinder may be subsequently brought up to speed and engaged with the blanket cylinder in one relative angular orientation to ensure proper registry, while the other image cylinder is disengaged, thereafter allowing that image cylinder to have its image plate or cassette changed.

The present invention includes a driving and clutching arrangement which allows an image cylinder which has been disengaged for image plate or cassette exchange to be restarted and engaged with the blanket cylinder in proper registry, while the other image cylinder which was engaged with the blanket cylinder and printing on the web is disengaged and stopped. Each image cylinder may have its own inking and dampening apparatus, or the two image cylinders may share an inking and dampening apparatus which switches at the same time that the image cylinders are switched. In an alternative embodiment of the present invention, two image cylinders and inking units are mounted together on a frame for lateral movement relative to the blanket cylinder, such that lateral movement of one image cylinder and inking unit away from, and out of engagement with, the blanket cylinder results in lateral movement of the other image cylinder and inking unit toward, and into engagement with, the blanket cylinder.

BRIEF DESCRIPTION OF THE DRAWINGS

The foregoing and other features of the present invention will become apparent to those skilled in the art to which the present invention relates from reading the following description with reference to the accompanying drawings, in which.

DETAILED DESCRIPTION OF THE INVENTION

Figure 1:
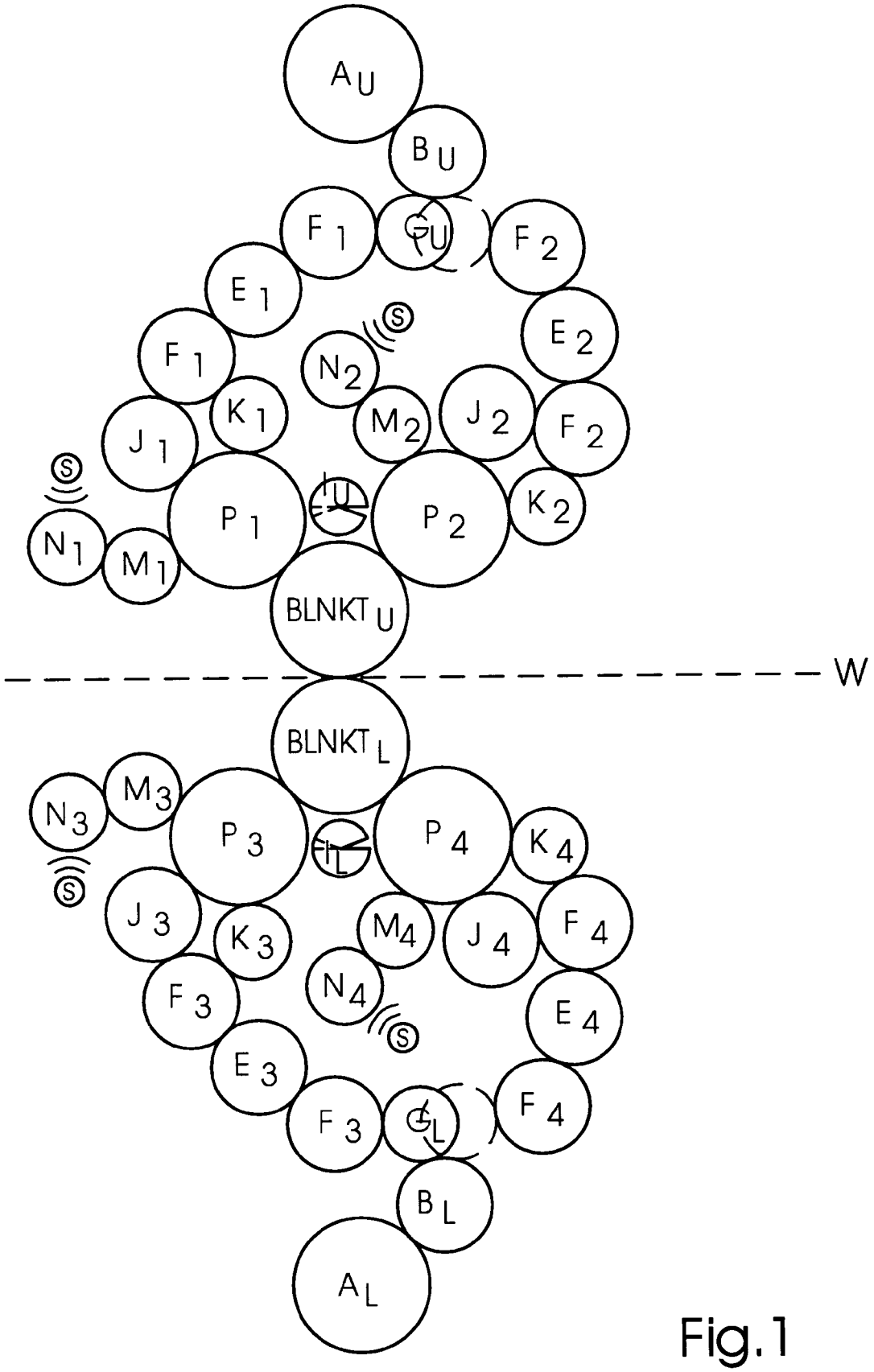
FIG. 1 is a schematic view of the ink train of one embodiment of the present invention.

FIG. 1 shows a schematic view of the printing apparatus of one embodiment of the present invention. In the embodiment of FIG. 1, the printing process being used is, e g., two fluid offset lithography. A web W passes between upper and lower blanket cylinders $BLNKT_U$, $BLNKT_L$. Each blanket cylinder $BLNKT_U$, $BLNKT_L$ has associated therewith two image cylinders, i.e., blanket cylinder $BLNKT_U$ has associated therewith image cylinders $P_1$, $P_2$, and blanket cylinder $BLNKT_L$ has associated therewith image cylinders $P_3$, $P_4$.

As is known in the art, blanket cylinders $BLNKT_U$, $BLNKT_L$ have thereon, preferably in the form of a removable blanket, an outer circumferential surface which transfers an inked image from the associated image cylinder in contact therewith to the side of web W in contact with the blanket cylinder $BLNKT_U$ or $BLNKT_L$. As described in more detail below, only one of the image cylinders $P_1$, $P_2$, $P_3$, $P_4$ is in contact with one of the blanket cylinders $BLNKT_U$ or $BLNKT_L$ at any one time. Each of the image cylinders $P_1$, $P_2$, $P_3$, $P_4$ has associated therewith its own inker train $K_1$, $J_1$, $F_1$, $E_1$, $F_1$; $K_2$, $J_2$, $F_2$, $E_2$, $F_2$; $K_3$, $J_3$, $F_3$, $E_3$, $F_3$; or $K_4$, $J_4$, $F_4$, $E_4$, $F_4$ respectively. Each of the image cylinders $P_1$, $P_2$, $P_3$, $P_4$ also has associated therewith its own dampener train S, $N_1$, $M_1$; S, $N_2$, $M_2$; S, $N_3$, $M_3$; or S, $N_4$, $M_4$ respectively.

In the embodiment of FIG. 1, the dampener trains shown include spray dampeners S. The associated ink trains for blanket cylinders $BLNKT_U$ or $BLNKT_L$ each share a common ink fountain roll $A_U$ or $A_L$, share a common ink metering roll $B_U$ or $B_L$ and share a common swing roll $G_U$ or $G_L$. The swing rolls $G_U$, $G_L$ swing from a first position (solid lines) in which they transfer ink to a first ink train $F_1$ and $F_3$, respectively, and a first image cylinder $P_1$ and $P_3$, respectively, to a second position (dashed lines) in which they transfer ink to a second ink train $F_2$ and $F_4$, respectively, and a second image cylinder $P_2$ and $P_4$, respectively. The upper image cylinders $P_1$, $P_2$ can also share a common digital imaging unit $I_U$ and the lower image cylinders $P_3$, $P_4$ can share a common digital imaging unit $I_L$. Digital imaging units $I_U$ and $I_L$ can be used to image, e.g., an imageable material from an image cassette mounted in the image cylinders $P_1$, $P_2$, $P_3$, $P_4$.

As an alternative to the configuration shown in FIG. 1, each image cylinder $P_1$, $P_2$, $P_3$, $P_4$ could have its own ink fountain roll, ink metering roll and swing roll. Such an embodiment, combined with a roller washing unit, would allow removal of all ink from the ink train for a particular image cylinder while it is not engaged with the blanket cylinder, followed by recharging of ink in the ink train, to thereby pre-ink the ink train with the correct coverage for the image on the image cylinder after presetting the ink fountain keys. In this way, the inker not in use could be washed up just after being removed from the printing process, and recharged with fresh ink just prior to returning to printing, at the same time that the other inker and image cylinder is in use for printing. This embodiment is particular advantageous when a printing cylinder is engaged in a printing process for an extended period of time, such that the ink in the inker not in use would otherwise start to dry on the rollers.

Operation of the device of FIG. 1 is as follows. An image cylinder $P_1$ bears an image (generally in the form of a plate on the outer circumference of image cylinder $P_1$ or imageable material from a cassette mounted in the image cylinder $P_1$) on its outer circumference, which transfers that image, after it is inked, to blanket cylinder $BLNKT_U$ through the transfer of ink from ink fountain roll $A_U$ through the first inker $K_1$, $J_1$, $F_1$, $E_1$, $F_1$. Blanket cylinder $BLNKT_U$ in turn prints the image on the upper portion of web W. At some point, either because of the necessity to clean the inker $K_1$, $J_1$, $F_1$, $E_1$, $F_1$, because of the need to change the image being printed, or because the image plate or cassette being used needs replacement, the reproduction of an image using image cylinder $P_1$ is halted and reproduction of an image using image cylinder $P_2$ commences (as will be readily understood, this description applies equally to the image cylinder $P_3$ and $P_4$ printing on the lower surface of the web W). As will be described in more detail below, image cylinder $P_2$ is brought up to speed and clutched into a gear. Thereafter, image cylinder $P_2$ is brought into contact ("on impression") with the blanket cylinder $BLNKT_U$ and image cylinder $P_1$ is brought out of contact ("off impression") with the blanket cylinder $BLNKT_U$. At the same time, the swing roll $G_U$ is switched in position so that it connects fountain roll $A_U$ with inker $K_2$, $J_2$, $F_2$, $E_2$, $F_2$. As a result, printing takes place through the second inker $K_2$, $J_2$, $F_2$, $E_2$, $F_2$ and second image cylinder $P_2$, while the first inker $K_1$, $J_\gamma$ $F_\gamma$ $E_\gamma$ $F_1$ and first image cylinder $P_1$ are idle.

One embodiment of the apparatus for changing over the operation of the image cylinders $P_1$, $P_2$, $P_3$, $P_4$ is shown in detail in FIGS. 2A–2C, 4 and 5. A blanket cylinder BLNKT includes a shaft 1 which is fixed to a blanket cylinder gear 2. As is known in the art, blanket cylinder gear 2 is driven by known driving mechanisms, resulting in rotation of blanket cylinder gear 2, shaft 1, and blanket blanket BLNKT. Blanket cylinder gear 2 is entrained with a clutchable image cylinder gear 3. Shaft 1 of blanket cylinder BLNKT is connected to a blanket cylinder shaft encoder 13. Image cylinder gear 3 is mounted for rotation on a bearing 4, which bearing is mounted on a shaft 5 of image cylinder P.

Also mounted on shaft 5 is a clutch mechanism 6, which moves along the length of shaft 5 and rotates with shaft 5. Clutch mechanism 6 includes, on a side facing image cylinder $P_1$, radially-outwardly projecting splines 7 which selectively engage with radially-inwardly projecting splines 8 on the inside circumference of image cylinder gear 3 when clutch mechanism 6 is in the position shown in FIG. 2A. Clutch mechanism 6 further includes, on a side facing away from image cylinder $P_1$, radially-outwardly projecting splines 9 which engage with radially-inwardly projecting splines 10 on the inside circumference of a first image cylinder auxiliary drive pulley 11 when clutch mechanism 6 is in the position shown in FIG. 2C. First image cylinder auxiliary drive pulley 11 is mounted for rotation on a bearing 12, which bearing is mounted on shaft 5 of image cylinder $P_1$.

Entrained over first image cylinder auxiliary drive pulley 11 is a belt or chain 14, which belt or chain 14 is also entrained over a second image cylinder auxiliary drive pulley 11' (FIGS. 4 and 5) and an auxiliary drive pulley 15. Auxiliary drive pulley 15 is driven by an auxiliary drive 16. In one embodiment of the invention (FIG. 4), the belt or chain 14 drives an idler pulley 31 connected to an auxiliary encoder 17. In an alternative embodiment (FIG. 5), the idler pulley 31 is not used, and the auxiliary encoder 17 is connected directly to auxiliary drive 16. In the alternative embodiment of FIG. 5, signals from the auxiliary encoder 17, reflecting both speed and phase angle, may be processed to ensure that signals derived from the rotation of auxiliary drive 16 are reflective of the speed and position of auxiliary drive pulleys 11, 11'.

Figure 6:
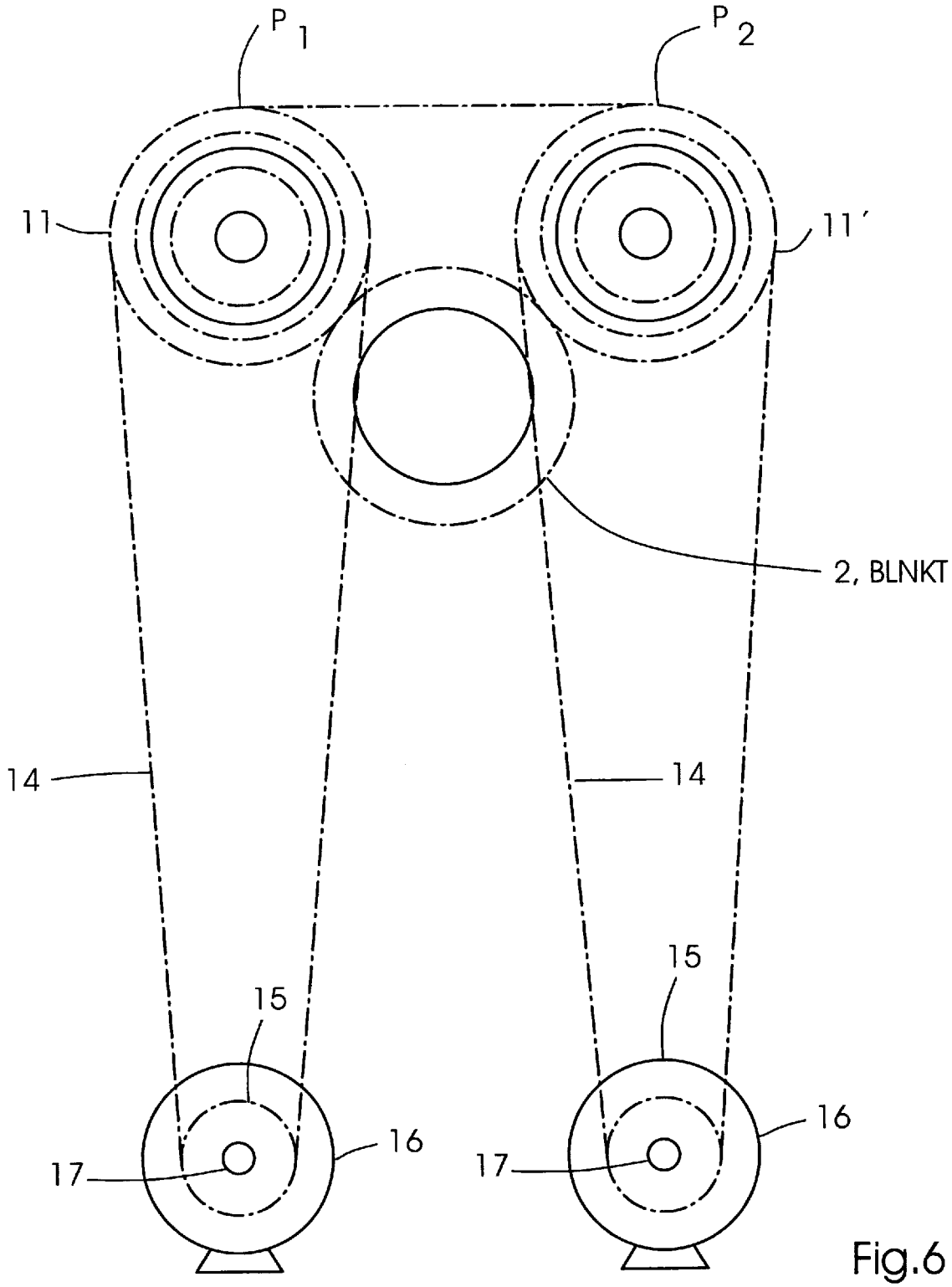
FIG. 6 is an end view of an alternative of the auxiliary drive and clutch arrangement of FIGS. 2A–2C.

In an alternative embodiment illustrated in FIG. 6, each of the plate cylinders $P_1$, $P_2$ has its own auxiliary motor 16, such that each auxiliary motor 16 accelerates and decelerates one of the plate cylinder $P_1$ or $P_2$ individually. In that embodiment, clutches and belts or chains could be used between the plate cylinder $P_1$ or $P_2$ and the respective auxiliary motor 16 which accelerates and decelerates it, or the auxiliary motor 16 could directly drive the respective plate cylinder $P_1$ or $P_2$.

Figure 2A:
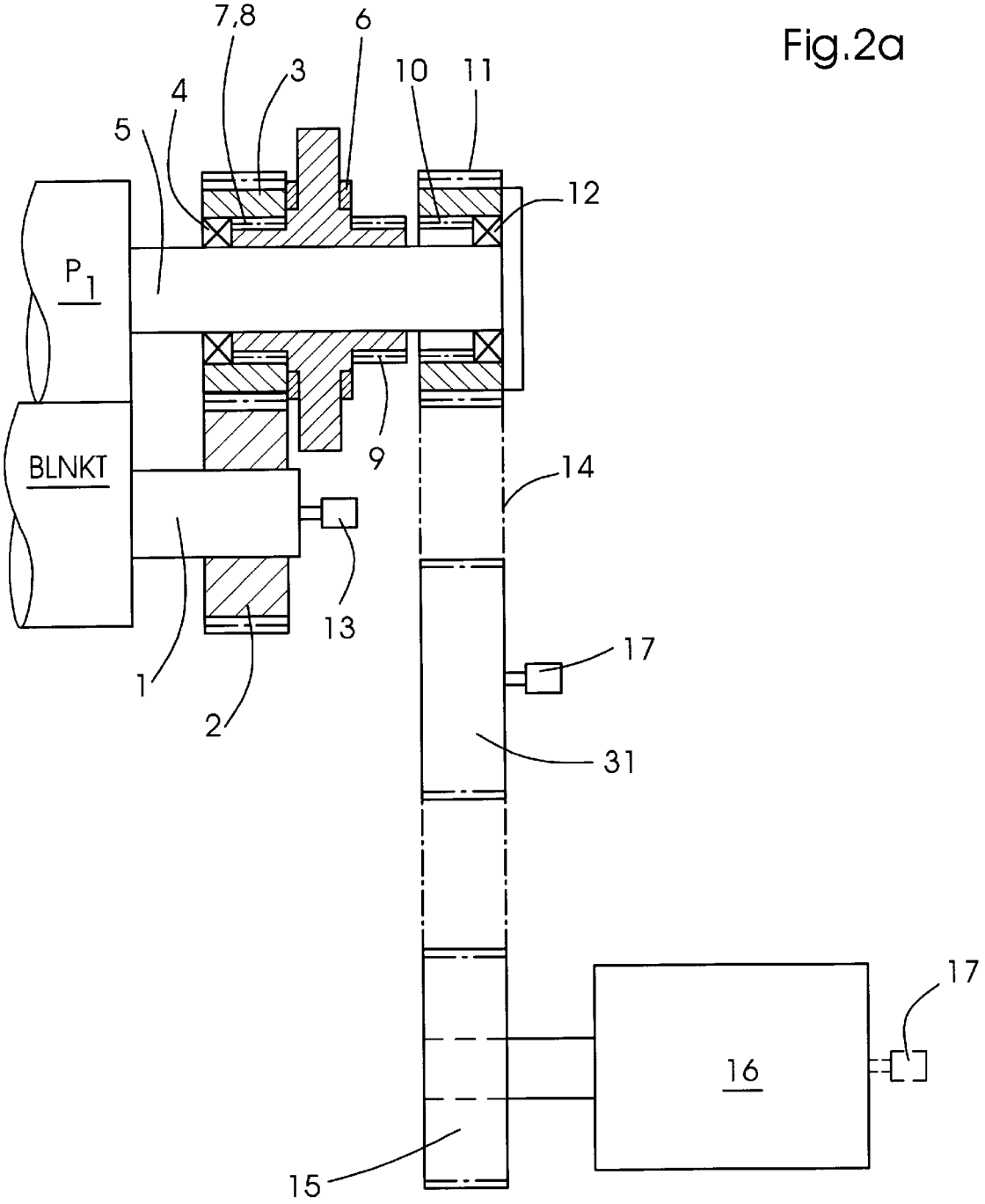
FIG. 2A is a side view of an auxiliary drive and clutch arrangement used in the present invention, with the clutch in the auxiliary driving position.
Figure 2B:
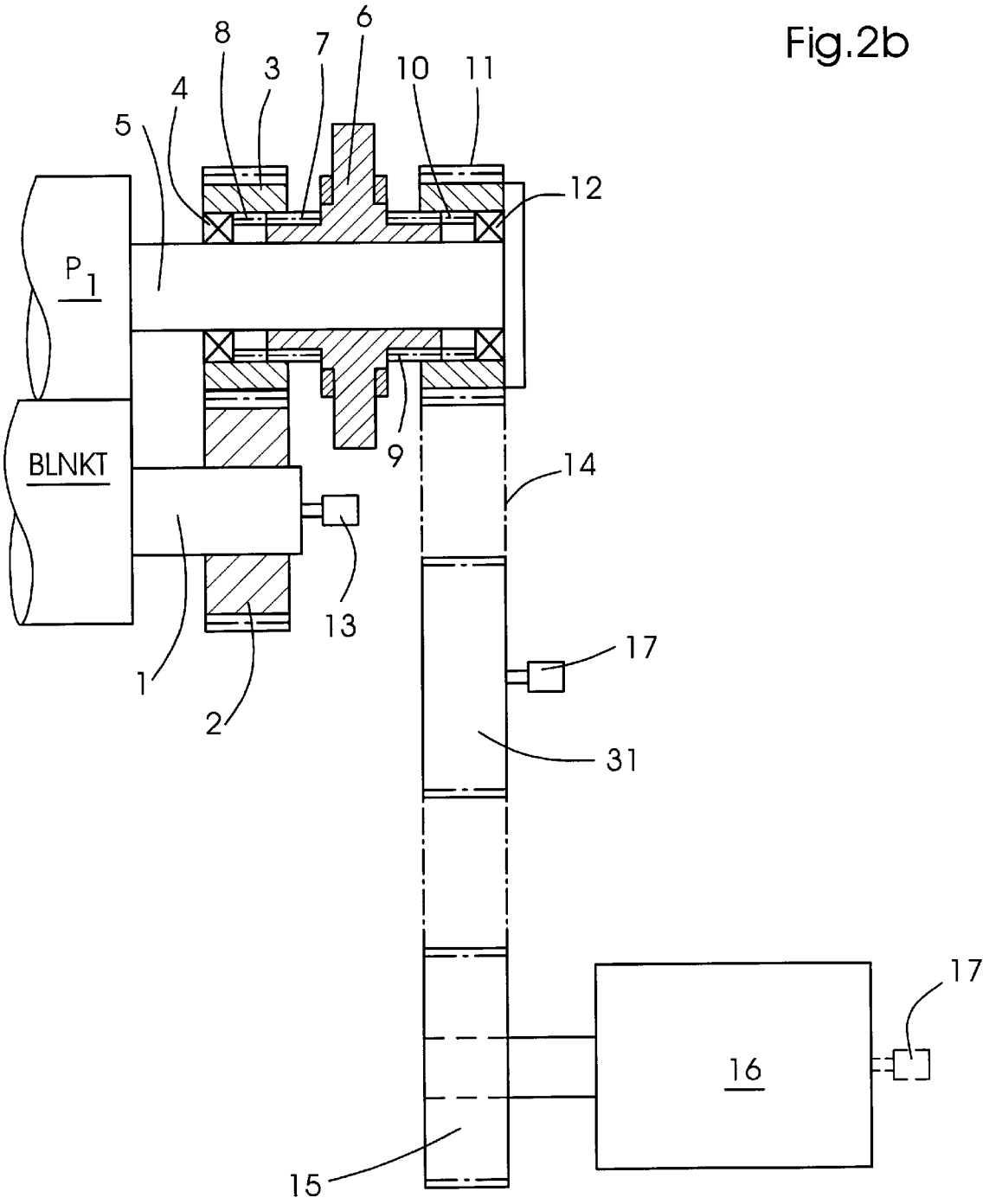
FIG. 2B is a side view of the auxiliary drive and clutch arrangement of FIG. 2A, with the clutch between the auxiliary driving position and the main driving position.

Operation of the auxiliary drive and clutching arrangement of the present invention will hereafter be described, with reference to FIGS. 2A–2C and FIGS. 4 and 5. FIG. 2A shows the present invention in a position in which the image cylinder $P_1$ is "on impression" and driven with blanket cylinder BLNKT. It is to be understood in FIG. 2A that a second image cylinder $P_2$ (not shown in FIG. 2A, shown in FIG. 4 and 5) is at the same time "off impression" and not driven with blanket cylinder BLNKT, as described in detail above and below. In the position of clutch mechanism 6 shown in FIG. 2A, the splines 7 and 8 engage one another, thereby connecting shaft 5 to image cylinder gear 3. As a result of this connection, as well as the entrainment of image cylinder gear 3 with blanket cylinder gear 2, image cylinder $P_1$ is driven by and with blanket cylinder BLNKT. At the same time the image cylinder $P_2$ is "off impression" and not driven with blanket cylinder BLNKT, i.e., a corresponding clutch mechanism 6 associated with image cylinder $P_2$ is in the position shown in FIG. 2C, and the image cylinder $P_2$ is spaced slightly from blanket cylinder BLNKT (i.e., "swung off" by conventional swing-off mechanisms for moving a image cylinder away from a blanket cylinder to change the plate on the image cylinder). In the position of clutch 6 shown in FIG. 2A, the shaft 5 is not coupled to the first image cylinder auxiliary drive pulley 11, and therefore the auxiliary drive 16 does not influence the image cylinder $P_1$.

Figure 2C:
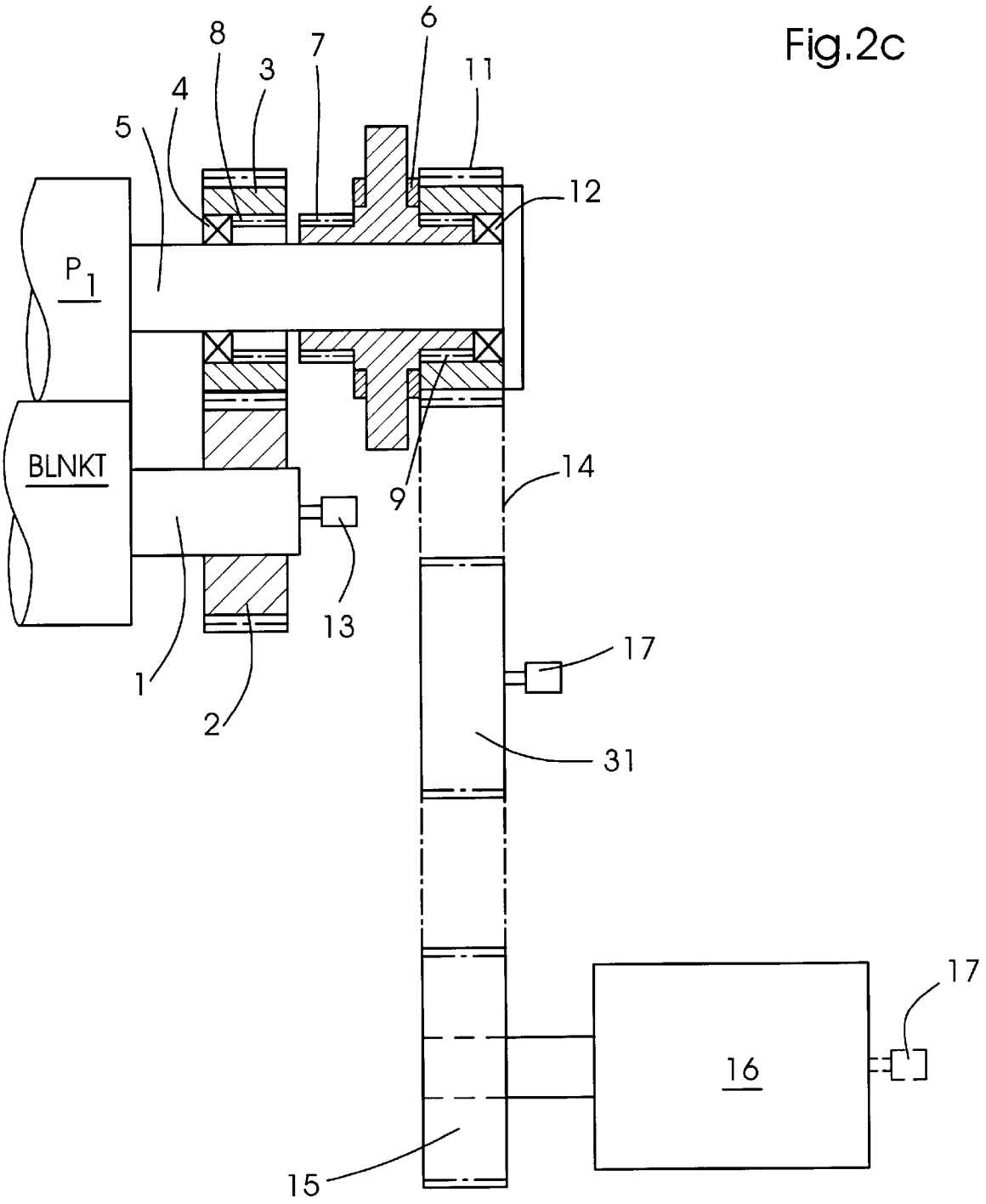
FIG. 2C is a side view of the auxiliary drive and clutch arrangement of FIG. 2A, with the clutch in the main driving position.

When it is desired to move image cylinder $P_1$ "off impression" and to stop image cylinder $P_1$ from being driven with blanket cylinder BLNKT, in order to change the image on that image cylinder, replace the plate on or cassette in that image cylinder, or to clean the inker for that cylinder, the image cylinder $P_2$ is brought up to speed with the blanket cylinder by running the auxiliary drive 16 when the clutch mechanism for image cylinder $P_2$ is in the position shown in FIG. 2C. A controller (not shown) compares the speed and phase measured by the auxiliary encoder 17, connected either to an idler pulley 31 entrained with the belt or chain 14 (FIG. 4) or directly to the auxiliary drive 16 (FIG. 5), with the speed and phase measured by the blanket cylinder shaft encoder 13, and adjusts the auxiliary drive 16 speed to obtain a speed match of the mating parts (splines 7 and 8 or splines 9 and 10) for clutching and declutching. Auxiliary encoder 17 measures the speed of the auxiliary drive 16 and therefore the speed of the drive pulley 11, while blanket cylinder shaft encoder 13 measures the speed of the blanket cylinder BLNKT and therefore of gear 3.

Registry can be achieved in one of two ways. First, the angular position or phase angle of the auxiliary drive 16 may be adjusted to achieve registry. This registry is accomplished by comparing the angular measured by the auxiliary encoder 17 with the angular position measured by the blanket cylinder shaft encoder 13 that turns once per blanket cylinder BLNKT revolution, and adjusting the phase angle of the auxiliary drive 16 until registry is achieved. Second, the splines 7, 8 can include a piloting element which allows a degree of relative rotation after engagement, and which causes an engagement in only in a specific angular position by piloting the splines to that engagement. The splines 7 and 8 are designed to allow clutching in only one position of the relative rotational angles of the image cylinders $P_1$, $P_2$ and blanket cylinder BLNKT to ensure image registration.

The clutch 6 for image cylinder $P_2$ is thereafter engaged, thereby causing image cylinder $P_2$ to be driven by the blanket cylinder gear 2. Next, image cylinder $P_2$ goes "on impression." At the same time, image cylinder $P_1$ is swung off blanket cylinder BLNKT, thereby "off impression," and the clutch 6 for image cylinder $P_1$ is moved to the position in FIG. 2C. The auxiliary drive 16 is thereafter slowed down until rotation of image cylinder $P_1$ is stopped. The plate on or cassette in image cylinder $P_1$ may then be changed, and the inker for that image cylinder may then be cleaned. Alternatively, a cassette (not shown) may be contained in an image cylinder $P_1$ and may be actuated to position a virgin layer of imageable material, or a pre-imaged layer, on the circumference of the image cylinder $P_1$. In this embodiment, the cassette need only be changed if all of the material within the cassette has been expended. The auxiliary drive 16, after changing of a cassette, may be used to drive the image cylinder $P_1$ while it is imaged by an imaging unit I. Of course, if it is desired thereafter to initiate printing with image cylinder $P_1$ and terminate printing with image cylinder $P_2$, the above-described procedure is reversed.

Figure 3A:
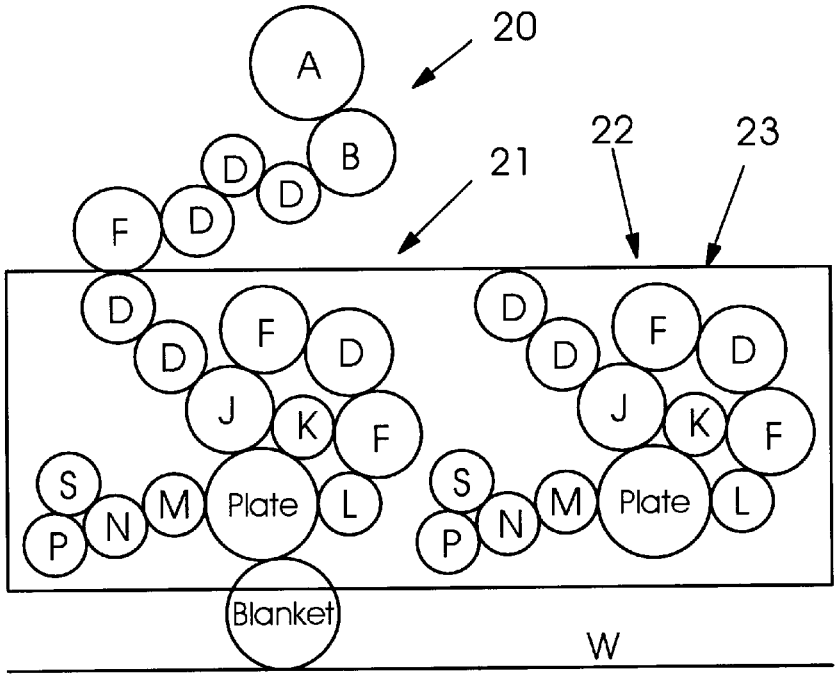
FIGS. 3A–3B show an alternative embodiment of the present invention, in first and second positions, respectively.
Figure 3B:
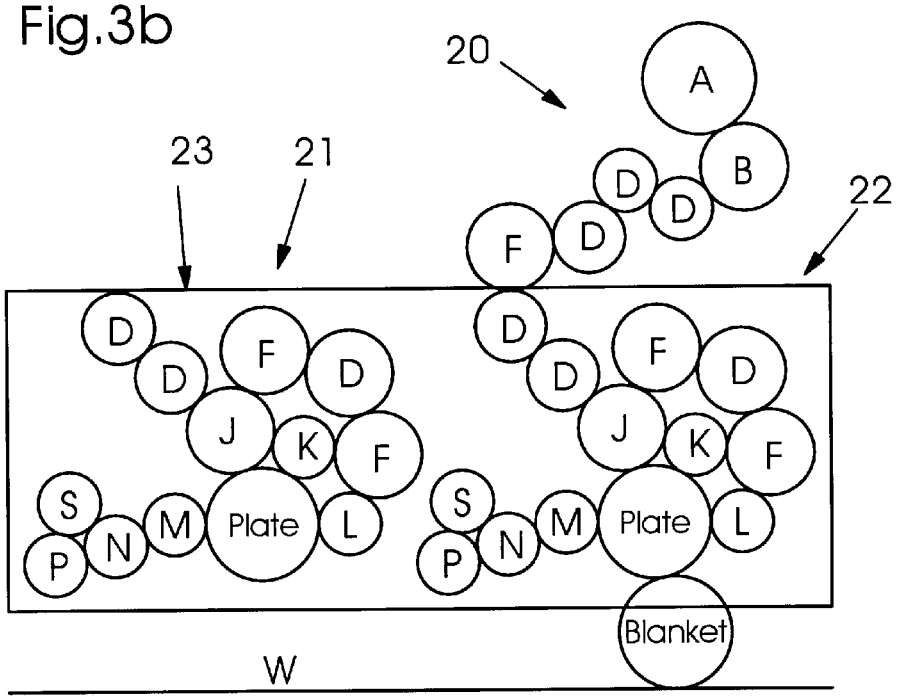
Figure 4:
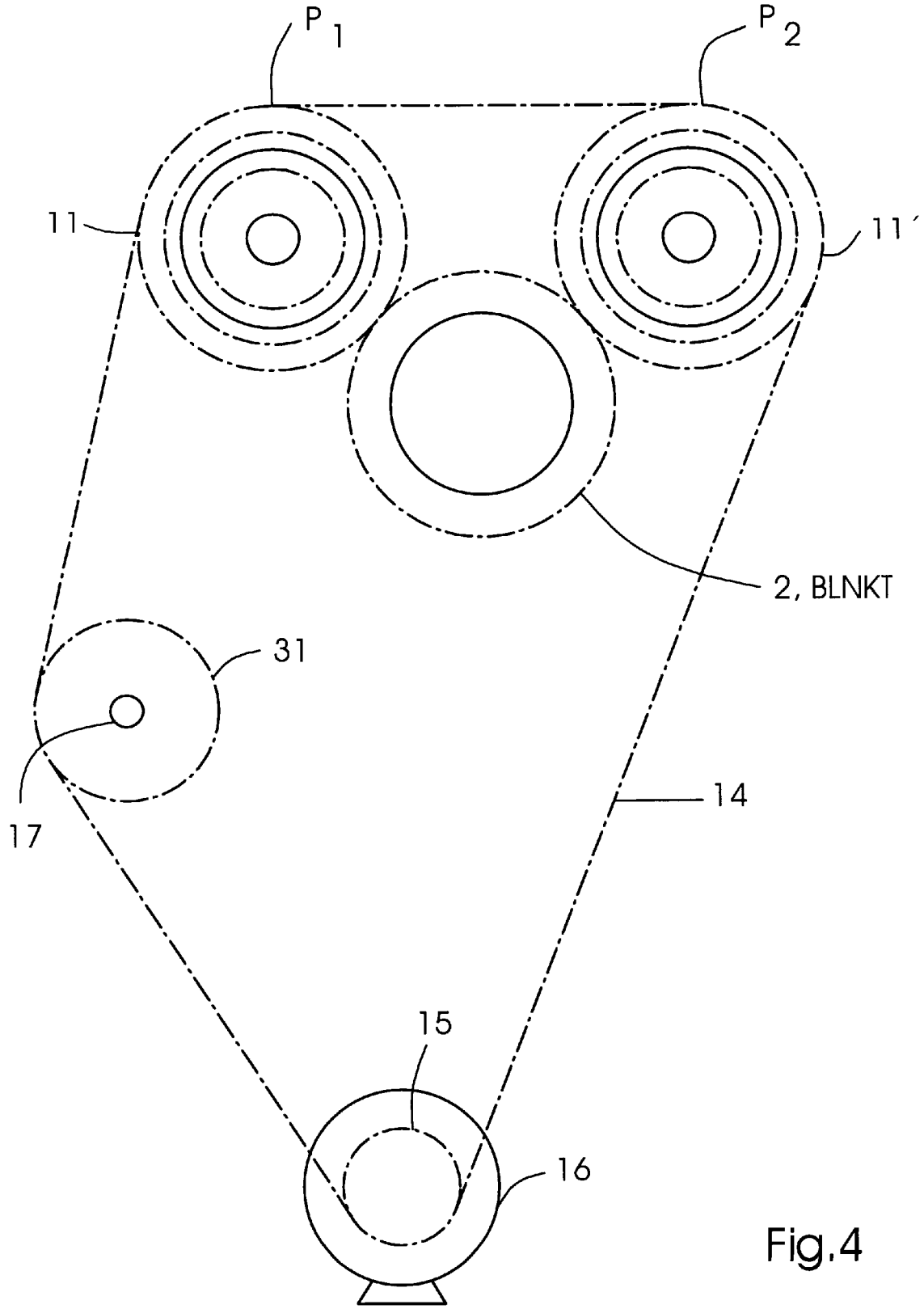
FIG. 4 is an end view of the auxiliary drive and clutch arrangement of FIGS. 2A–2C.
Figure 5:
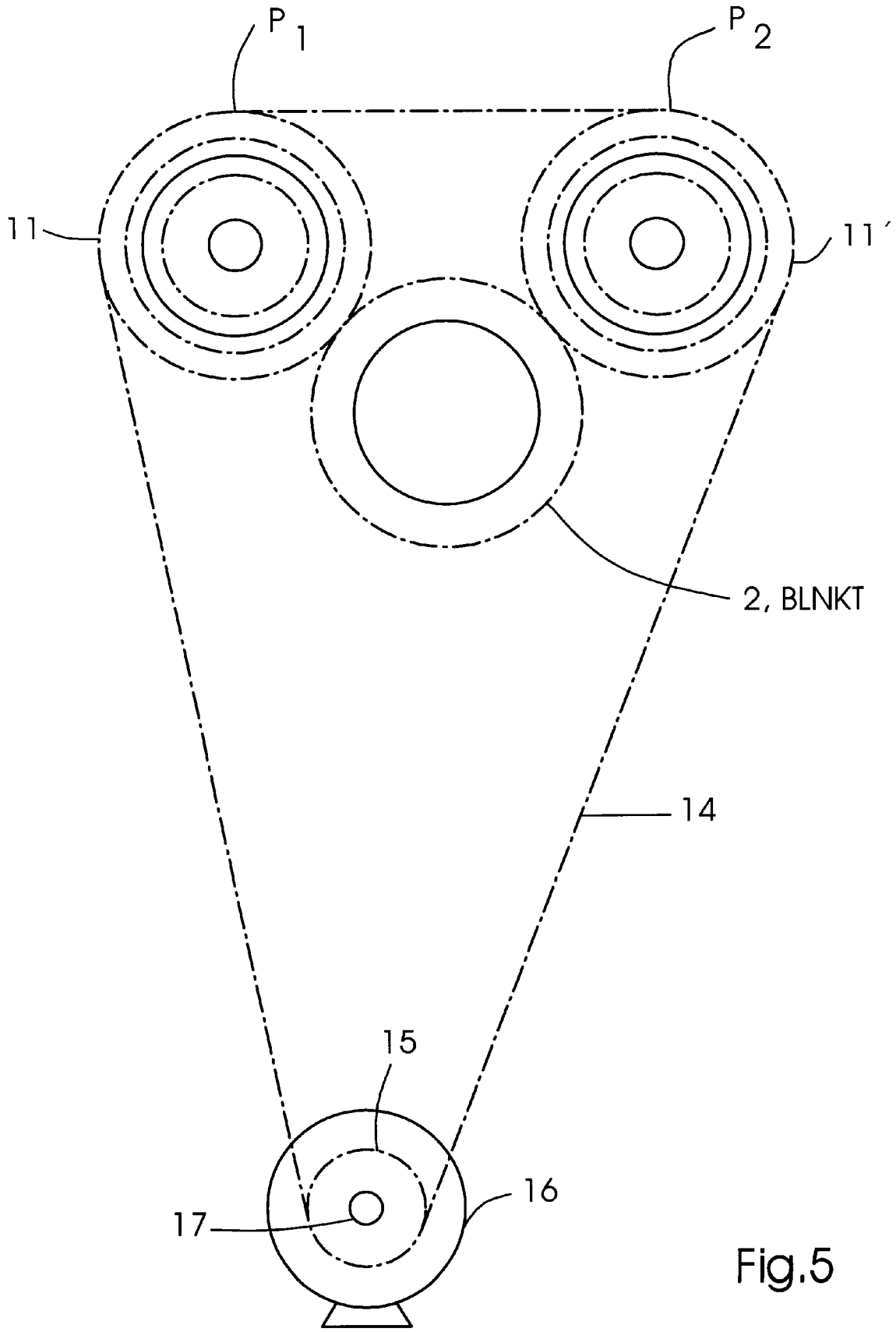
FIG. 5 is an end view of an alternative of the auxiliary drive and clutch arrangement of FIGS. 2A–2C.

FIGS. 3A and 3B show an alternative embodiment of the present invention. In the embodiment of FIG. 3, a blanket cylinder BLANKET is engaged with a web W. The blanket cylinder BLANKET has mounted above it a laterally-shiftable frame 23, on which are mounted a first inking and imaging unit 21 and a second inking and imaging unit 22. First and second imaging units 21, 22 have various rollers D, F, J, K, L, M, N, P, and S. Inking and imaging units 21, 22 each include their own inker and plate cylinder. Mounted above frame 23 is a common ink fountain unit 20. Fountain unit 20 has various rollers A, B, D, and F. FIG. 3A shows a first position of the frame 23, and FIG. 3B shows a second position of the frame 23. In the first position of the frame 23, the first inking and imaging unit 21 connects the ink fountain unit 20 to the blanket cylinder BLANKET, while the second inking and imaging unit 22 is disconnected from the ink fountain unit 20 and the blanket cylinder BLANKET. In the first position of the frame 23 of FIG. 3A, the image plate or cassette on second inking and imaging unit 22 may be changed, and the second inking and imaging unit 22 may be cleaned. In the second position of the frame 23, the second inking and imaging unit 22 connects the ink fountain unit 20 to the blanket cylinder BLANKET, while the first inking and imaging unit 21 is disconnected from the ink fountain unit 20 and the blanket cylinder BLANKET. In the second position of the frame 23 of FIG. 3B, the image plate on or cassette in first inking and imaging unit 21 may be changed, and the first inking and imaging unit 21 may be cleaned.

In the above description of the invention, those skilled in the art will perceive improvements, changes and modifications. Such improvements, changes and modifications within the skill of the art are intended to be covered by the appended claims.

What is claimed is:

1. A printing press comprising:

at least one blanket cylinder;

at least one ink fountain unit;

a first image cylinder and a second image cylinder, the first and second image cylinders being movably mounted for movement relative to the at least one blanket cylinder, the first and second image cylinders being selectively engageable with the at least one blanket cylinder, whereby the first image cylinder may be disengaged from the at least one blanket cylinder when the second image cylinder is engaged with the at least one blanket cylinder, and whereby the second image cylinder may be disengaged from the at least one blanket cylinder when the first image cylinder is engaged with the at least one blanket cylinder;

a first inker supplying ink to the first image cylinder;

a second inker supplying ink to the second image cylinder; and a movable frame, the first and second image cylinders being mounted on the movable frame, the movable frame being movable from a first position at which the first image cylinder is engaged with the at least one blanket cylinder, to a second position at which the second image cylinder is engaged with the at least one blanket cylinder, the first and second inker being mounted on the movable frame.

2. The printing press of claim 1, wherein:

in the first position of the movable frame, the ink fountain unit supplies ink to the first image cylinder, and in the second position of the movable frame, the ink fountain unit supplies ink to the second image cylinder.

3. The printing press of claim 1, further comprising:

a second ink fountain unit, the at least one ink fountain unit supplying ink to the first image cylinder and the second ink fountain unit supplying ink to the second image cylinder.

4. A printing press comprising:

at least one blanket cylinder;

at least one ink fountain roll;

a first image cylinder and a second image cylinder, the first and second image cylinders being movably mounted for movement relative to the at least one blanket cylinder, the first and second image cylinders being selectively engageable with the at least one blanket cylinder, whereby the first image cylinder may be disengaged from the at least one blanket cylinder when the second image cylinder is engaged with the at least one blanket cylinder, and whereby the second image cylinder may be disengaged from the at least one blanket cylinder when the first image cylinder is engaged with the at least one blanket cylinder;

a first ink train supplying ink to the first image cylinder;

a second ink train supplying ink to the second image cylinder; and a swing roller, the swing roller being movable from a first position, at which the ink fountain roll supplies ink, through the swing roller, to the first ink train and to the first image cylinder, to a second position, at which the ink fountain roll supplies ink, through the swing roller, to the second ink train and to the second image cylinder.

5. A method of changing images in a printing press, comprising:

providing at least one blanket cylinder;

providing at least one ink fountain unit;

providing a first image cylinder and a second image cylinder, the first and second image cylinders being selectively engageable with the at least one blanket cylinder;

mounting the first and second image cylinders on a movable frame;

providing a first inker and a second inker;

mounting the first inker and the second inker on the movable frame;

supplying ink to the first image cylinder through the first inker;

disengaging the first image cylinder from the at least one blanket cylinder when the second image cylinder is engaged with the at least one blanket cylinder;

supplying ink to the second image cylinder through the second inker;

disengaging the second image cylinder from the at least one blanket cylinder when the first image cylinder is engaged with the at least one blanket cylinder; and moving the movable frame from a first position at which the first image cylinder is engaged with the at least one blanket cylinder to a second position at which the second image cylinder is engaged with the at least one blanket cylinder.

6. The method of claim 5, further comprising:

connecting the ink fountain unit to the first image cylinder in the first position of the movable frame; and connecting the ink fountain unit to the second image cylinder in the second position of the movable frame.

7. The method of claim 5, further comprising:

providing a second ink fountain unit; and supplying ink to the first image cylinder using the at least one ink fountain unit and supplying ink to the second image cylinder using the second ink fountain unit.

8. A method of changing images in a printing press, comprising:

providing at least one blanket cylinder;

providing at least one ink fountain roll;

providing a first image cylinder and a second image cylinder, the first and second image cylinders being selectively engageable with the at least one blanket cylinder;

providing a first ink train and a second ink train;

supplying ink to the first image cylinder through the first ink train;

disengaging the first image cylinder from the at least one blanket cylinder when the second image cylinder is engaged with the at least one blanket cylinder;

supplying ink to the second image cylinder through the second ink train;

disengaging the second image cylinder from the at least one blanket cylinder when the first image cylinder is engaged with the at least one blanket cylinder; and providing a swing roller;

moving the swing roller from a first position at which the ink fountain roll supplies ink, through the swing roller, to the first image cylinder, to a second position at which the ink fountain roll supplies ink, through the swing roller, to the second image cylinder.

9. A printing press comprising:

at least one blanket cylinder;

at least one ink fountain roll;

a first image cylinder and a second image cylinder, the first and second image cylinders being movably mounted for movement relative to the at least one blanket cylinder, the first and second image cylinders being selectively engageable with the at least one blanket cylinder, whereby the first image cylinder may be disengaged from the at least one blanket cylinder when the second image cylinder is engaged with the at least one blanket cylinder, and whereby the second image cylinder may be disengaged from the at least one blanket cylinder when the first image cylinder is engaged with the at least one blanket cylinder;

a first auxiliary motor accelerating and decelerating the first image cylinder;

a second auxiliary motor accelerating and decelerating the second image cylinder; and a swing roller, the swing roller being movable from a first position, at which the ink fountain roll supplies ink, through the swing roller, to a first ink train and to the first image cylinder, to a second position, at which the ink fountain unit supplies ink, through the swing roller, to a second ink train and to the second image cylinder.

10. The printing press of claim 9, further comprising:

a second ink fountain roll, the at least one ink fountain roll supplying ink to the first image cylinder and the second ink fountain roll supplying ink to the second image cylinder.

* * * * *